US006700548B1

(12) United States Patent
Chen et al.

(10) Patent No.: US 6,700,548 B1
(45) Date of Patent: Mar. 2, 2004

(54) DUAL BAND ANTENNA FEED USING AN EMBEDDED WAVEGUIDE STRUCTURE

(75) Inventors: Ming Hui Chen, Rancho Palos Verdes, CA (US); Rong Chan Hsieh, Taipei (TW); Wei Tse Cheng, Tainan Hsien (TW)

(73) Assignee: Victory Industrial Corporation, Taipei Hsine (TW)

( * ) Notice: Subject to any disclaimer, the term of this patent is extended or adjusted under 35 U.S.C. 154(b) by 0 days.

(21) Appl. No.: 10/256,663

(22) Filed: Sep. 27, 2002

(51) Int. Cl.[7] ..... H01Q 13/10

(52) U.S. Cl. ..... 343/771; 343/772; 343/786; 333/135

(58) Field of Search ..... 343/771, 772, 343/782; 333/126, 135; H01Q 13/10

(56) References Cited

U.S. PATENT DOCUMENTS

| | | | | | |
|---|---|---|---|---|---|
| 4,491,810 | A | * | 1/1985 | Saad | 333/126 |
| 4,912,436 | A | * | 3/1990 | Alford et al. | 333/135 |
| 5,859,620 | A | * | 1/1999 | Skinner et al. | 343/880 |
| 6,046,702 | A | * | 4/2000 | Curtis et al. | 343/776 |
| 2002/0175875 | A1 | * | 11/2002 | Verstraeten | 343/786 |

* cited by examiner

*Primary Examiner*—Tho Phan
(74) *Attorney, Agent, or Firm*—Fliesler Meyer LLP

(57) ABSTRACT

A dual band antenna feed is made with an embedded waveguide structure to enable combining of Ka and Ku band signals without the need for an additional cavity-type filter. The antenna feed includes a Ka and Ku band interface section (22) with two Ka band vertical polarization waveguide sections (31) and (32), and a single Ku band waveguide section (34) which carries both vertical and horizontal polarization Ku band signals. The opposing walls (36–37) of the Ku band waveguide (34) carrying the vertical polarization Ku band signals are transitioned to step down from an input section (40) to successively smaller dimensioned sections (41–44), and then to step back up in successively larger dimensioned sections (45–47) to an output section (48). The two Ka band sections (31–32) are fed into openings in Ku band section.(46), on opposite sides of the opening for the Ku band transition section (45). The output section (48) then provides a combined Ka band vertical and Ku band horizontal and vertical signals. With the Ka-band waveguides (31–32) having ports (56–57) facing the antenna port for radiation on opposite sides of the Ku-band section (45) port, sufficient isolation will be provided between the Ka and Ku band signals without requiring an additional filter. A dielectric insert (FIG. 8A) may be included to improve performance characteristics of the antenna feed.

18 Claims, 7 Drawing Sheets

SECTION A-A

FRONT VIEW

SECTION A-A

SECTION B-B

BACK VIEW

FRONT VIEW

SECTION A-A

SECTION B-B

BACK VIEW

FRONT VIEW

SECTION A-A

FRONT VIEW

SECTION A-A

DUAL BAND ANTENNA FEED USING AN EMBEDDED WAVEGUIDE STRUCTURE

BACKGROUND

1. Technical Field

The present invention relates to dual band antenna feeds for combining two or more different frequency antenna feeds to connect to a single antenna.

2. Related Art

The dual band antenna feeds are usually designed by connecting two waveguide ports carrying signals over two separate frequency bands to a common waveguide structure which connects to an antenna operating over both bands. As illustrated in block diagram form in FIG. 1, a conventional antenna feed receives a first high frequency band of signals at input 2. The second lower frequency band is received at input 4. A filter 6, which may be a low pass, band pass, or band stop filter removes higher frequency components from the low frequency input 4 to prevent interference with signals from the high frequency input 2. Cavity-type filters are used as filter 6 to connect the waveguide ports to the common waveguide and avoid interference between the two frequency bands. Since a filter is a frequency sensitive device, its cost is high due to the tight tolerance and tuning requirements. A common junction 8 combines the signals from ports 2 and 4 to provide an output for an antenna 10.

SUMMARY

The present invention provides a dual band antenna feed using an embedded waveguide structure made without requiring an added cavity-type filter. The dual band antenna feed of the present invention is made amenable to die-casting.

The dual band antenna feed in accordance with the present invention, referring to FIG. 2, includes a Ka and Ku band interface section 22. The interface section 22 has signals fed from a orthogonal mode transducer (OMT) and power combiner section 20. The output of the Ka and Ku band interface section 22 is provided to an antenna section 24.

The Ka and Ku band interface section 22, referring to FIGS. 3A–3D, includes two Ka band vertical polarization waveguide sections 31 and 32, and a single Ku band waveguide section 34 which carries both vertical and horizontal polarization Ku band signals. The opposing walls 36–37 of the Ku band waveguide 34 carrying the vertical polarization Ku band signals are transitioned to step down from an input section 40 to successively smaller dimensioned sections 41–44, and then to step back up in successively larger dimensioned sections 45–47 to an output section 48. The two Ka band sections 31–32 are fed into openings in the combined Ka/Ku band section 46, on opposite sides of the opening for the Ku band transition section 45. A slightly larger Ka/Ku band section 47 then transitions from section 46 to the output section 48. The output section 48 provides a combined Ka band vertical and Ku band horizontal and vertical signals. The output section 48 connects to the separate antenna section (24). With the Ka-band waveguides 31–32 having ports 56–57 facing the antenna port for radiation on opposite sides of the Ku-band section 45 port, sufficient isolation will be provided between the Ka and Ku band signals without requiring an additional filter.

The OMT and power combiner section 20 can have components as shown in FIGS. 4A–4D. The OMT 90 is a conventional device with separate Ku band vertical and horizontal polarization inputs 12 and 14 which combines the inputs to produce a single output carrying both the vertical and horizontal polarization Ku band signals. The power combiner has a first input (16) for receiving the Ka band vertical polarization signal, and functions to split the input into two separate signals provided in two separate Ka band vertical polarization waveguides 81–82.

The Ka and Ku band interface section 22 can be manufactured from a single block of stock metal. The stock metal block is first cut into two halves, and the Ka band waveguides are machined into the halves. The two halves are then each cut in half to form a total of four quarter sections. The Ku band waveguide is then machined into the quarter sections, and the quarter sections are reassembled to form the completed interface section 22. The quarter sections can be used to form molds which are then used for die casting to enable rapid manufacturing of multiple interface sections 22.

In one embodiment, the antenna feed can include a dielectric insert as shown in FIGS. 8A–8C. The dielectric insert includes Ka band inserts 110 and 111 which insert into Ka band sections 31 and 32 to improve matching between the Ka band sections 31 and 32 and combined Ka/Ku band section 46. A notch 114 is further included to improve the match between the Ku band section 45 and combined Ka/Ku band section 46. The insert has a rectangular portion 106 which transitions into a tapered conical section 108 which extends into the antenna portion 24 of the antenna feed.

DESCRIPTION OF THE DRAWINGS

Further details of the present invention are explained with the help of the attached drawings in which.

DETAILED DESCRIPTION

Figure 2:
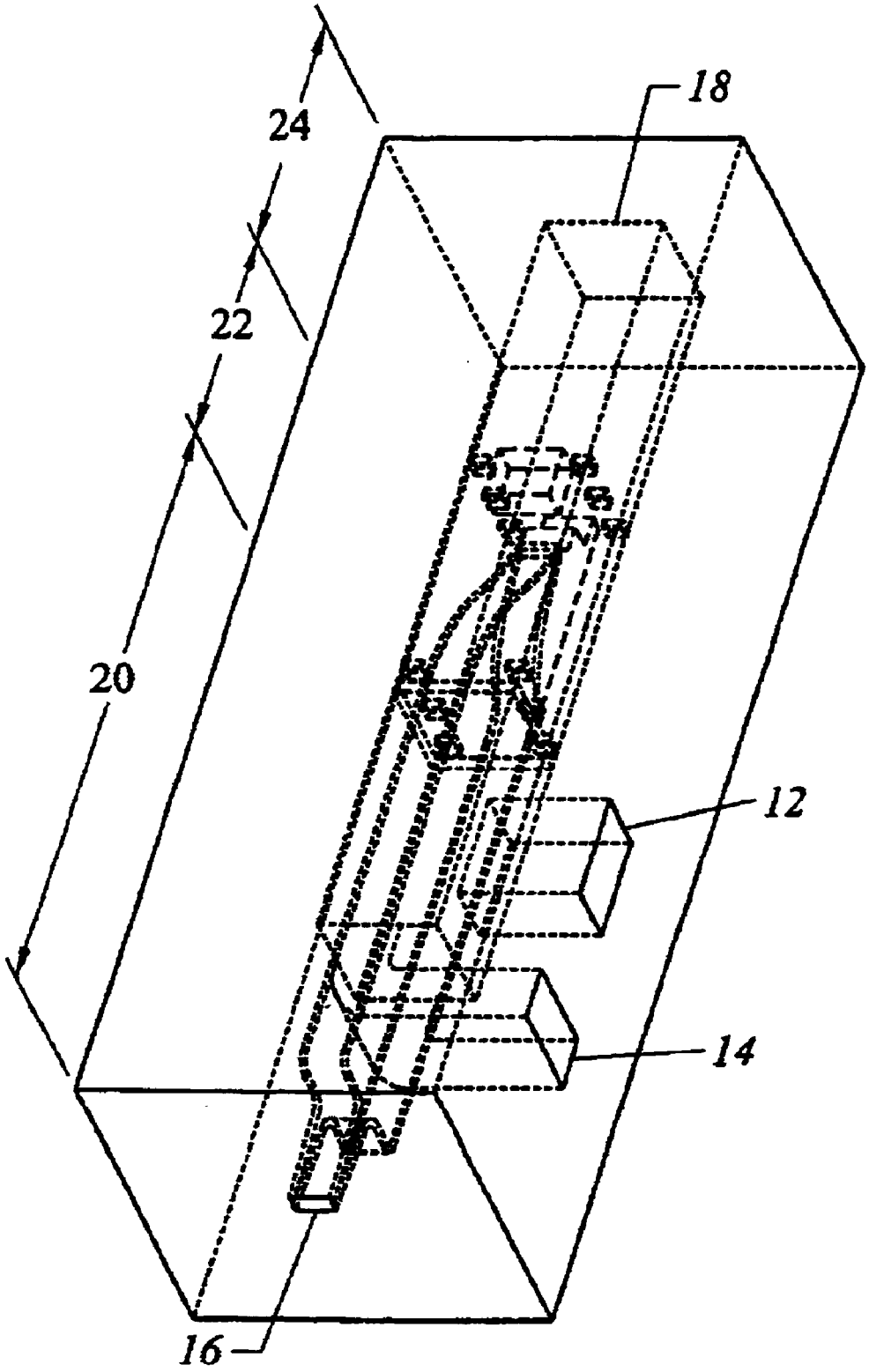
FIG. 2 shows a perspective view of exterior and interior portions of an antenna feed assembly in accordance with the present invention.
Figure 3A:
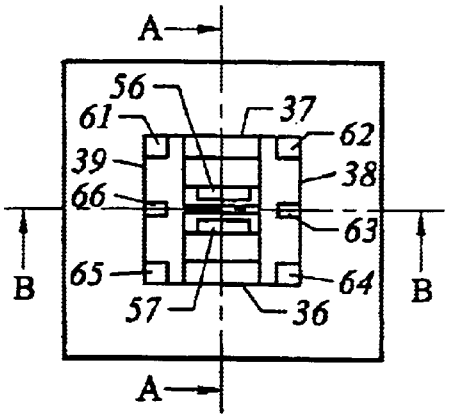
FIGS. 3A–3D show cutaway and end views of a Ku and Ka band interface 22 section of the antenna feed of FIG. 2.
Figure 3B:
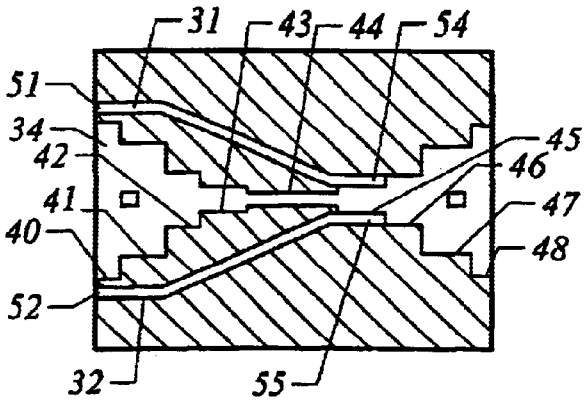
Figure 3C:
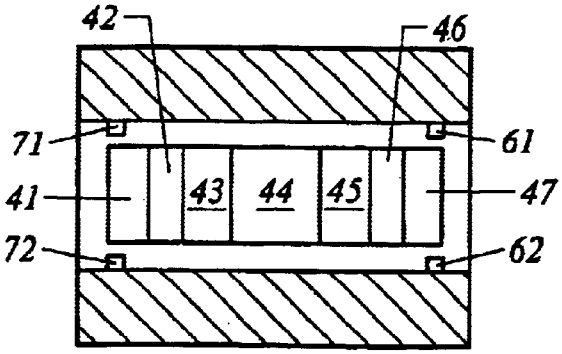
Figure 3D:
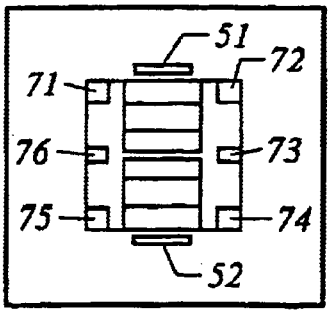
Figure 4A:
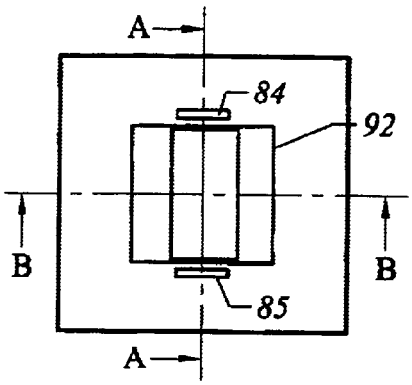
FIGS. 4A–4D show cutaway and end views of the OMT and power combiner section 20 of the antenna feed of FIG. 2.
Figure 4B:
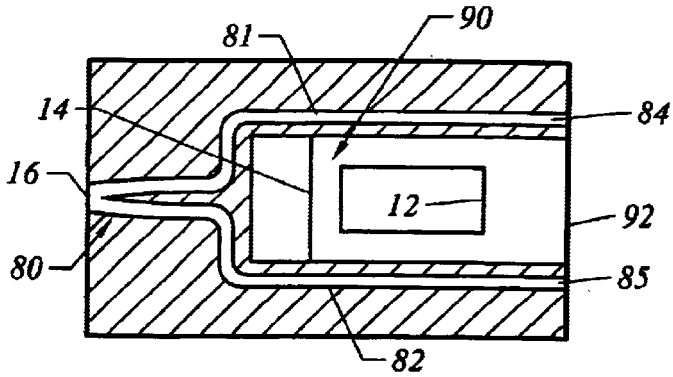
Figure 4C:
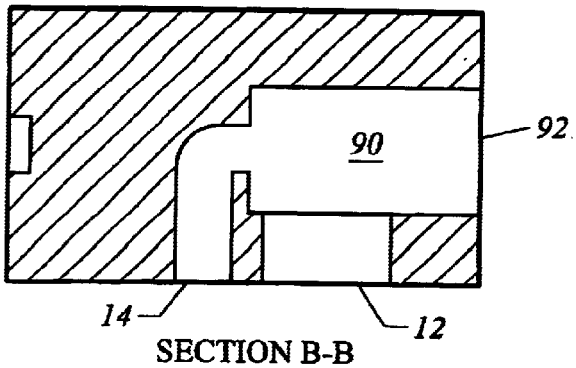
Figure 4D:
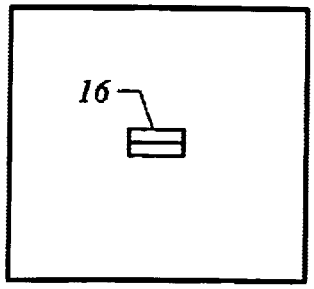

FIG. 2 shows an antenna feed in accordance with the present invention. The antenna feed has four ports: Ku-band vertical polarization 12, Ku-band horizontal polarization 14, Ka-band vertical polarization 16, and the antenna port 18. The ports 12 and 14 are indicated as being Ku-band, while the port 16 is indicated as being Ka band for purposes of illustration. Other bands may be used in accordance with the present invention.

The antenna feed of FIG. 2 can be considered as three separate sections 20, 22 and 24. A first section 20 is a combined orthogonal mode transducer (OMT) and power combiner, which is shown in more detail in FIGS. 4A–4D. The OMT portion combines signals from the horizontal and vertical polarization Ku band inputs 12 and 14. The power combiner portion splits the Ka vertical band signal received at port 16 into two separate waveguides. The combined OMT and power combiner 20 is described in more detail with reference to FIGS. 4A–4D to follow.

The second section 22 is a Ku and Ka band interface, which is shown in more detail in FIGS. 3A–3D. The Ku and Ka band interface 22 is configured to direct the Ku and Ka band signals from the combined OMT and power combiner section 20 to form a single combined signal for launching at an antenna connection port. The Ku and Ka band interface section 22 is described in more detail with reference to FIGS. 3A–3D to follow.

The third section 24 is the antenna for connecting to the Ku and Ka band interface section 22. The antenna section 24 shown in FIG. 2 is described in more detail with reference to FIGS. 5A–5B. An alternative conical shaped antenna may be used in place of antenna 24, and is described with reference to FIGS. 6A–6B to follow.

FIGS. 3A–3D show cutaway and end views of a Ku and Ka band interface 22 section of the antenna feed of FIG. 2. The Ku and Ka band interface section 22 includes two rectangular Ka band waveguides 31–32. The two Ka band waveguides 31–32 are fed from two similar waveguides in the combined OMT and power combiner 20, as described in more detail to follow with regard to FIGS. 4A–4D.

The Ku and Ka band interface section 22 further includes a single Ku band waveguide 34 for carrying both Ku vertical and horizontal polarization signals. The Ku band waveguide 34 includes a square input section 40. From the square input section 40, the opposing waveguide walls 36–37 carrying the vertical polarization signals are transitioned in steps 41–44 down to a minimum size and then back in steps 45–47 to a section 48. Section 48 is the size of the square input section 40, and forms the output of the Ku band waveguide 34. The opposing waveguide walls 38–39 carrying the horizontal polarization signals remain the same dimension from the input section 40 through transitions 41–47 to the output section 48.

The Ka band waveguides 31–32 are routed from initial points 51 and 52 spaced laterally a slight distance from respective opposing vertical waveguide walls 36–37 of the initial section 40 of the Ku band waveguide 34 to final points 54 and 55 spaced a slight distance from respective opposing vertical waveguide walls of the transition section 45. The Ka band waveguides 31–32 are then terminated in openings 56 and 57 in the Ka/Ku band section 46. By terminating the Ka band waveguides 31–32 in openings 56 and 57 in the Ka/Ku band section 46, the Ka band signals are launched and combined with the Ku band signals in section 46. The combined Ku and Ka band vertical polarization signals are then transitioned using section 47 to the square waveguide output section 48. The output section 48 of the Ku and Ka band interface provides a connection to the antenna section 24.

Figure 1:
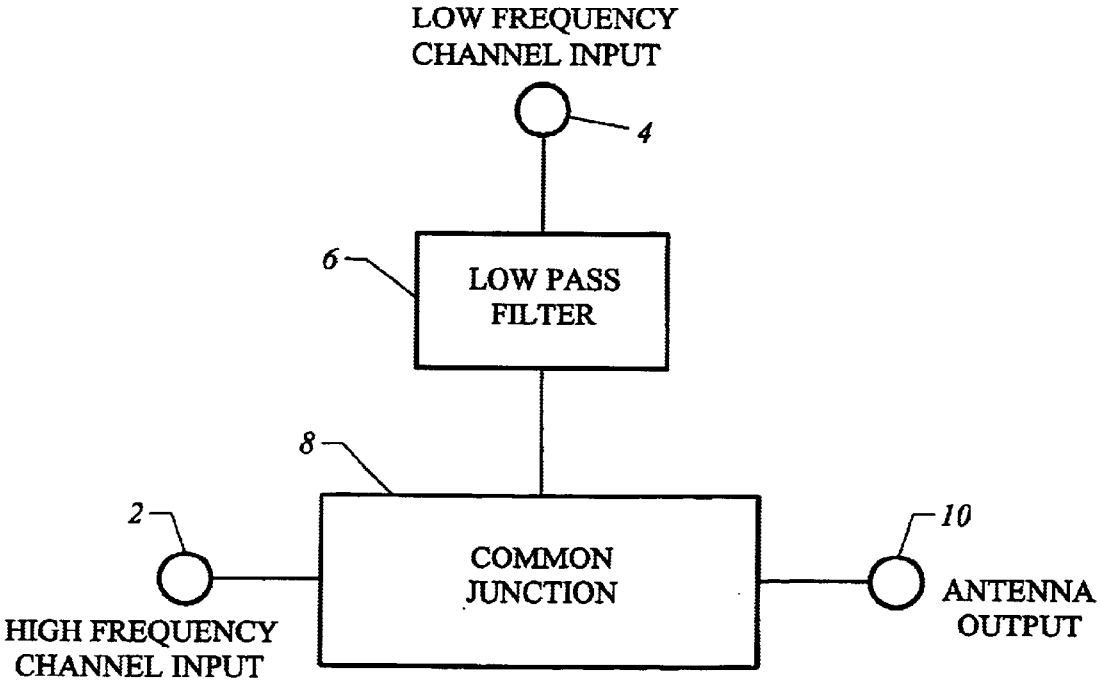
FIG. 1 (Prior Art)
FIGS. 1 show a block diagram of components of a conventional dual-band antenna feed.

Since the openings 56 and 57 of the Ka-band waveguides 31 and 32 are facing the antenna port for radiation and provided on opposite sides of the Ku-band port of section 45, there will be sufficient isolation even without a filter. Thus a filter, such as filter 6 of FIG. 1, provided between the Ku band input and the common junction at section 46 with the higher frequency Ka band signals is unnecessary.

The two separated Ka-band waveguides 31–32 are used instead of a single waveguide launch into section 46 to excite symmetrical modes. The symmetrical modes enable an antenna beam created from a signal at the output section 48 to be aligned with the physical center of the antenna section 24.

As shown in FIGS. 3A–3D, Ku and Ka band interface section 22 includes six tuning stubs 61–66 on the initial section 40, and another six tuning stubs 71–76 on the output section. The tuning stubs help optimize the performance of the Ku and Ka band interface section 22 by minimizing reflections or return losses. Although shown with tuning stubs located in the areas illustrated, it is understood that the tuning stubs might be located at other areas without significantly degrading performance. Likewise, the tuning stubs may be eliminated without a significant degradation in performance, depending on desired performance.

FIGS. 4A–4D show cutaway and end views of the OMT and power combiner section 20 of the antenna feed of FIG. 2. As indicated above the OMT and power combiner of FIGS. 4A–4D includes a single Ka band input 16 and a power combiner 80 (or power splitter) which transitions the single Ka band input 16 into two Ka band waveguide portions 81–82 which are routed around an ortho-mode transducer (OMT) 90 to provide Ka band waveguide outputs 84–85 for connection to matching waveguide sections 31–32 in the Ka and Ku band transition section 22. Note that labels to similar items, such as Ka band input 16, are carried over from FIG. 2 to FIG. 4. Labels for items carried forward will likewise be similarly labeled in other subsequent drawings.

The OMT 90 is a conventional device and includes the vertical polarization Ku band input 12 and the horizontal polarization Ku band input 14. The vertical and horizontal polarization signals from inputs 12 and 14 are combined by the OMT 90 into a single square waveguide section 92 which supports both horizontal and vertical polarizations. The square waveguide section 92 mates with the similar square wave guide section 40 of the Ku and Ka band interface section 22 shown in FIGS. 3A–3D.

Figure 5A:
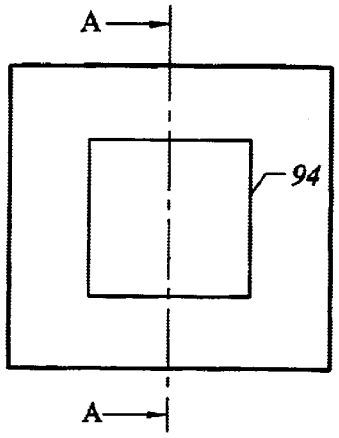
FIGS. 5A–5B show a cutaway and a front view of the antenna section 24 of the antenna feed of FIG. 2.
Figure 5B:
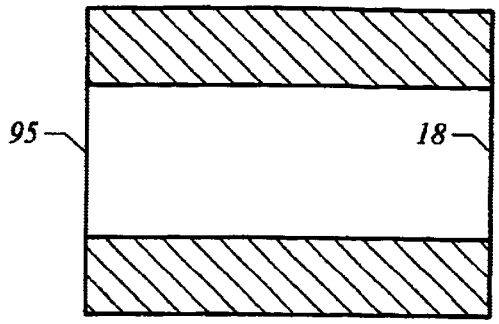

FIGS. 5A–5B show a cutaway and a front view of the antenna section 24 of the antenna feed of FIG. 2. As shown the antenna section 24 includes a square waveguide 94 matching the dimensions of the square waveguide output section 48 of the Ku and Ka band interface section 22. One port 95 of the square waveguide 94 mates with the Ku and Ka band interface section 22, while a second port 18 forms the antenna output 18.

Figure 6A:
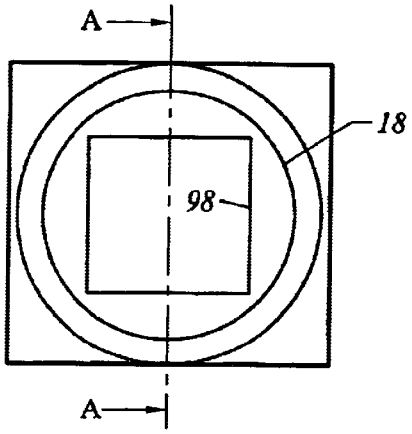
FIGS. 6A–6B show a cutaway and a front view of an alternative conical antenna usable as the antenna portion 24 of the antenna feed of FIG. 2.
Figure 6B:
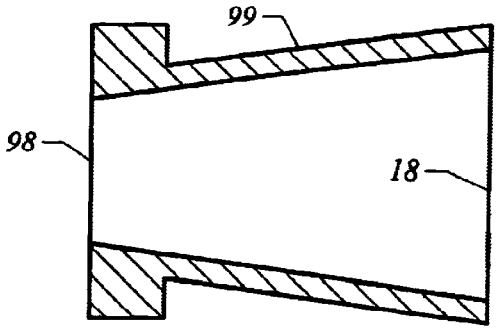

FIGS. 6A–6B show a cutaway and a front view of an alternative conical antenna usable as the antenna portion 24 of the antenna feed of FIG. 2. The conical antenna of FIGS. 6A–6B provides one alternative to simply using the square waveguide of FIGS. 5A–5B, although other antennas may be used depending on desired design and performance requirements. The conical antenna of FIGS. 6A–6B will typically provided decreased return losses and a lower VSWR than the square waveguide of FIGS. 5A–5B. The antenna section of FIGS. 6A–6B includes a square waveguide portion making up a first port 98 for mating with the square waveguide output section 48 of the Ku and Ka band interface section 22. The antenna section then includes a conical shaped transition section for transitioning from the first square port 98 to a second larger round port 18 which forms the antenna output. A part of the exterior 98 of the antenna portion 24 is also machined to form a conical shape feed horn to improve antenna performance.

Figures 7A, 7B, 7C, 7D, 7E:
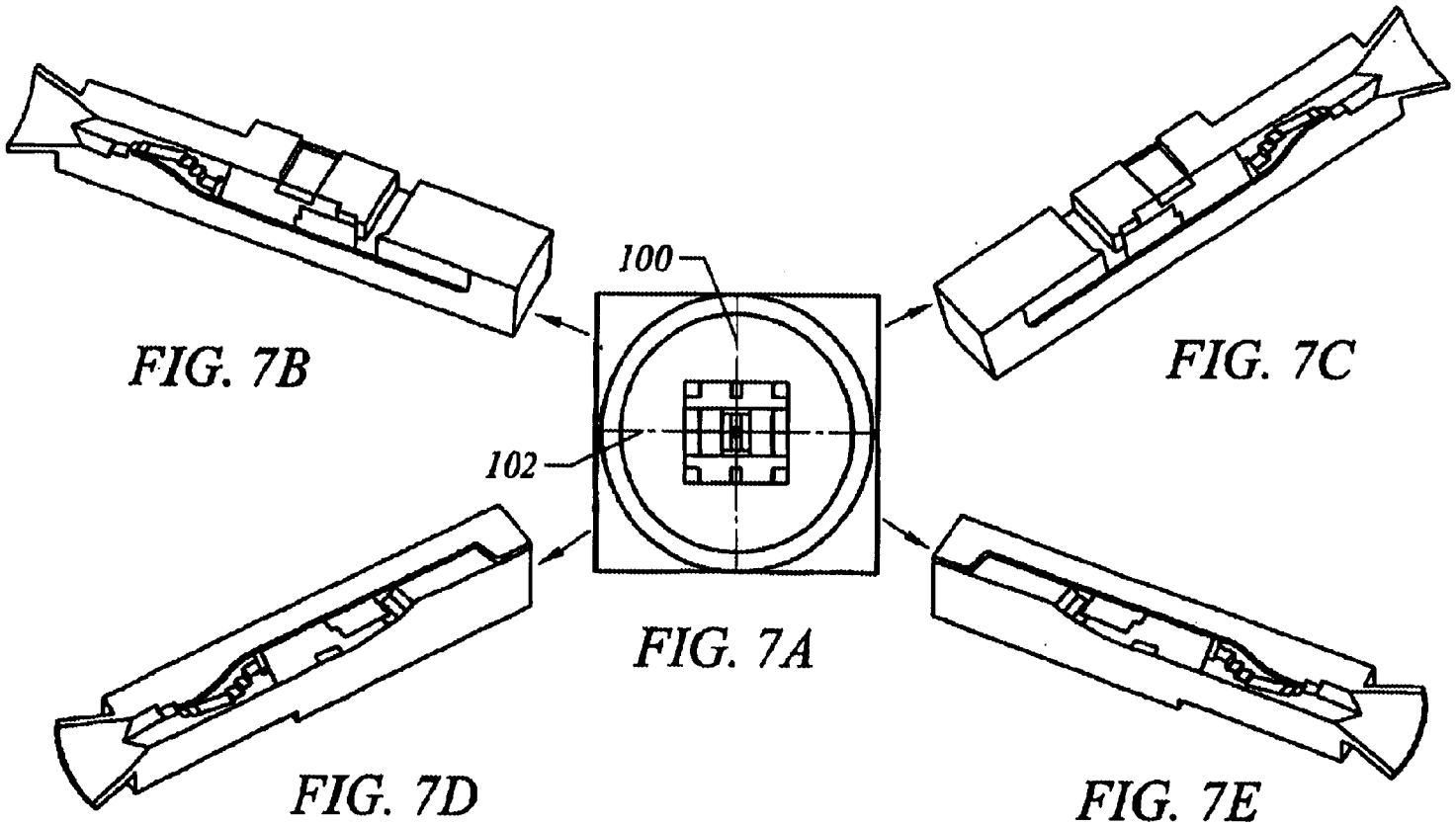
FIGS. 7A–7E, illustrate cuts made in stock metal to enable manufacturing of an embodiment of the antenna feed of the present invention.

FIGS. 7A–7E illustrate cuts to make in stock metal to enable manufacturing of all of sections 20, 22 and 24 combined as a single unit. For such manufacturing, a solid stock metal block sized to form the entire assembly of sections 20, 22 and 24 is used. Assuming that a conical antenna portion 24 is used as illustrated in FIGS. 6A and 6B, both the inside and outside portion of the conical horn is initially machined using a lathe. Next, the metal block is cut in half longitudinally along line 100 as illustrated in FIG. 7A. Next a deep double ridge is cut into each half so that when the halves are reassembled the Ka band waveguides 31, 32, 81 and 82 are formed. With the halves reassembled, another longitudinal cut 102 is made to cut the stock metal block into quarters as illustrated in FIG. 7A. The four quarter sections are then machined with the additional Ku band waveguide and combined Ku and Ka band waveguide portions as shown in FIGS. 7B–7E. The four quarter sections of FIGS. 7B–7E are then reassembled to form the completed unit.

Once machined, the quarter sections of FIGS. 7B–7E can be used for form casts so that molds may be made to allow die casting. Die cast sections can be manufactured at a low cost relative to machined sections. Note that although the entire assembly of sections 20, 22 and 24 are illustrated as being manufactured together, the individual sections may be manufactured in a similar manner by matching quarter sections, and then assembling the quarter sections to form a completed unit.

Figure 8A:
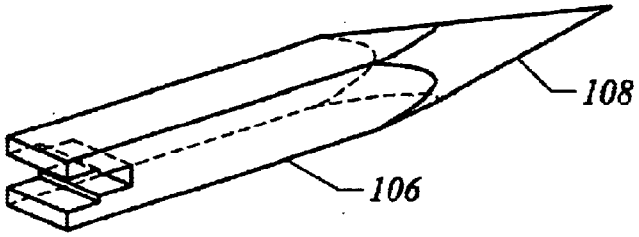
FIGS. 8A–8C illustrate a dielectric insert which can be provided as part of the antenna feed of the present invention for improved performance.
Figure 8C:
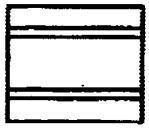
Figure 8B:
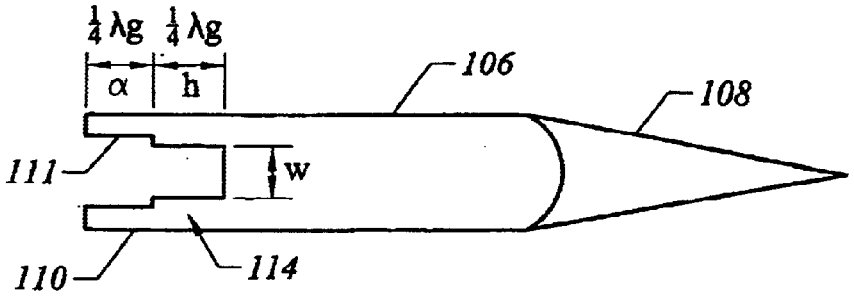

FIGS. 8A–8C illustrate a dielectric insert which can be provided as part of the antenna feed of the present invention for improved performance. FIG. 8A shows a perspective view of the dielectric insert. FIG. 8B shows a side view of the dielectric insert, and FIG. 8C shows a back view. The dielectric insert includes Ka band insert portions 110 and 111 which are designed to extend into the Ka band waveguide portions 31 and 32 at respective ends 54 and 55. The Ka band insert portions 110 and 111 preferably extend a distance ¼ λg of the Ka band waveguide into sections 31 and 32 to improve matching between the Ka band waveguides 31 and 32 and the combined Ka/Ku band waveguide section 46.

The dielectric insert further includes a rectangular portion 106 with dimensions preferably matching the Ka/Ku band section 46. The rectangular section 106 then extends through sections 47 and 48, transitioning into a conical tapered section 108. The conical tapered section 108 extends into the antenna portion 24 and preferably terminates at a point prior to the antenna opening 18. The dielectric insert provides improved antenna performance for either the waveguide antenna shown in FIGS. 5A and 5B, or the conical antenna shown in FIGS. 6A and 6B.

The dielectric insert in one embodiment further includes a notch 114 cut into the rectangular section 106 for the purpose of matching and reducing the backward wave of a Ka band signal. The notch 114 has a height dimension h and a width dimension w. The height dimension h is preferably ¼ λg at Ka band. This notch produces another backward wave 180 degrees out of phase to cancel the original residue backware wave. This minimizes the Ka band backward wave. The width dimension w is adjusted to a desired value to maximize performance of the antenna feed over the desired bandwidth of operation. The tapered conical portion 108 is tapered to minimize reflections of signals launched from the antenna portion 24.

The dielectric insert can be manufactured from a desired material such as Nylon or Teflon if a low dielectric constant is desired, or from other materials if a higher dielectric constant is desired. For manufacturing the stock material is simply machined into the shape shown in FIG. 8A. The dielectric insert is securely attached to the antenna feed by applying an adhesive material to the Ka band inserts 110 and 111, and to the rectangular portion 106 which contacts the walls of the Ka/Ku band section 46.

Although the present invention has been described above with particularity, this was merely to teach one of ordinary skill in the art how to make and use the invention. Many additional modifications will fall within the scope of the invention, as that scope is defined by the claims which follow.

What is claimed is:

1. An antenna feed comprising:

first and second Ka band vertical polarization waveguides;

a Ku band horizontal and vertical polarization waveguide, the Ku band waveguide comprising:

an input section;

an output section;

transition sections having opposing waveguide walls for carrying vertical polarization signals from a first dimension at the input section to a smaller dimension than the first dimension at a signal combining transition section, and then back to a larger dimension than the dimension of the signal combining transition section at the output section, wherein the first and second Ka band waveguides are routed into openings in the signal combining transition section.

2. An antenna feed of claim 1, wherein the transition sections further comprise:

Ku band step down sections between the input section and the signal combining transition section, each of the Ku band step down sections having opposing waveguide walls for carrying vertical polarization signals with a dimension less than a previous one of the step down sections, wherein the first and second Ka band waveguides are provided laterally spaced from the opposing waveguide walls of the Ku band step down sections for carrying vertical polarization signals.

3. An antenna feed of claim 2, wherein the transition sections further comprise:

a Ku band step up section between the Ku band step down sections and the signal combining transition section, wherein the first and second Ka band waveguides are provided laterally spaced from opposing waveguide walls of the Ku band step up section for carrying vertical polarization signals, and wherein the Ku band step up section terminates into an opening in the signal combining transition section between the openings for the first and second Ka band waveguides.

4. The antenna feed of claim 3, wherein the first and second Ka band waveguides are rectangular waveguides, and wherein the input and the output sections of the Ku band waveguide are square waveguide sections.

5. The antenna feed of claim 4, wherein the Ku band waveguide carries Ku band vertical polarization signals between opposing walls having a uniform separation in the transition sections.

6. The antenna feed of claim 1, wherein the first and second Ka band waveguide and the Ku band waveguide are manufactured in a single piece of metal, by a method comprising the steps of:

cutting the piece of metal into two halves;

machining the first and second Ka band waveguides in the two halves;

cutting each of the two halves into two halves to form four quarter sections;

machining the Ku band waveguide into the quarter sections; and assembling the quarter sections to form the antenna feed.

7. The antenna feed of claim 1, further comprising a dielectric insert, the dielectric insert comprising:

a rectangular body portion having peripheral dimensions substantially matching dimensions of the signal combining transition section, the rectangular body portion being provided in the signal combining transition section;

a tapered conical section extending from a first end of the rectangular body portion; and waveguide inserts extending from a second end of the rectangular body portion into the first and second Ka band waveguides, the waveguide inserts having peripheral dimensions substantially matching dimensions of the first and second Ka band waveguides.

8. The antenna feed of claim 7, wherein the dielectric insert further comprises:

a notch provided in the rectangular body portion between the waveguide inserts.

9. The antenna feed of claim 8, wherein the waveguide inserts extend ¼ wavelength of the first and second Ka band waveguides from the rectangular body portion, and wherein the notch extends ¼ wavelength of the signal combining transition section into the rectangular body portion.

10. The antenna feed of claim 9, wherein the output section of the antenna feed connects to an antenna, and wherein the tapered conical section of the dielectric insert extends into the antenna.

11. An antenna feed assembly comprising:

an OMT and power combiner section comprising:

a power combiner having a first terminal forming a Ka band waveguide input section, a second terminal forming a first Ka band waveguide output, and a terminal forming a second Ka band waveguide output;

an OMT comprising a Ku band horizontal input, a Ku band vertical input, and a Ku band output for carrying signals provided from both the Ku band horizontal input and the Ku band output;

a Ka and Ku band transition section comprising:

first and second Ka band vertical polarization waveguides for connecting to the first and second Ka band waveguide outputs of the power combiner;

a Ku band horizontal and vertical polarization waveguide, the Ku band waveguide comprising:

an input section for connecting to the Ku band output of the OMT;

an output section;

transition sections having opposing waveguide walls for carrying vertical polarization signals from a first dimension at the input section to a smaller dimension than the first dimension at a signal combining transition section, and then back to a larger dimension than the dimension of the signal combining transition section at the output section, wherein the first and second Ka band waveguides are routed into openings in the signal combining transition section; and an antenna section comprising:

an antenna having an input for connecting to the output section of the Ku band waveguide of the Ka and Ku band transition section.

12. An antenna feed of claim 11, wherein the transition sections further comprise:

Ku band step down sections between the input section and the signal combining transition section, each of the Ku band step down sections having opposing waveguide walls for carrying vertical polarization signals with a dimension less than a previous one of the step down sections, wherein the first and second Ka band waveguides are provided laterally spaced from the opposing waveguide walls of the Ku band step down sections for carrying vertical polarization signals.

13. An antenna feed of claim 12, wherein the transition sections further comprise:

a Ku band step up section between the Ku band step down sections and the signal combining transition section, wherein the first and second Ka band waveguides are provided laterally spaced from opposing waveguide walls of the Ku band step up section for carrying vertical polarization Ku band signals, and wherein the Ku band step up section terminates into an opening in the signal combining transition section between the openings for the first and second Ka band waveguides.

14. The antenna feed of claim 13, further comprising a dielectric insert, the dielectric insert comprising:

a rectangular body portion having peripheral dimensions substantially matching dimensions of the signal combining transition section, the rectangular body portion being provided in the signal combining transition section;

a tapered conical section extending from a first end of the rectangular body portion, the tapered conical section provided in the antenna section, but not extending beyond the antenna section;

waveguide inserts extending from a second end of the rectangular body portion into the first and second Ka band waveguides, the waveguide inserts having peripheral dimensions substantially matching dimensions of the first and second Ka band waveguides, the waveguide inserts extending ¼ wavelength of the first and second Ka band waveguides from the rectangular body portion, wherein the rectangular body portion includes a notch provided between the waveguide inserts, wherein the notch extends ¼ wavelength of the signal combining transition section into the rectangular body portion.

15. An antenna feed comprising:

first and second waveguides for carrying a vertical polarization of a first band of signal frequencies;

a third waveguide for carrying both horizontal and vertical polarizations of a second band of signal frequencies having a frequency range lower than at least a portion of the first band of signal frequencies, the third waveguide comprising:

an input section;

an output section;

having first opposing waveguide walls for carrying the vertical portion of the second band of signals, and second opposing walls for carrying a horizontal portion of the second band of signals; and transition sections having opposing waveguide walls for carrying vertical polarization signals of the second band of signals from a first dimension at the input section to a smaller dimension than the first dimension at a signal combining transition section, and then back to a larger dimension than the dimension of the signal combining transition section at the output section, wherein the first and second waveguides are routed into openings in the signal combining transition section.

16. An antenna feed of claim 15, wherein the transition sections further comprise:

step down sections between the input section and the signal combining transition section, each of the step down sections having opposing waveguide walls for carrying vertical polarization signals of the second band of signals with a dimension less than a previous one of the step down sections, wherein the first and second waveguides are provided laterally spaced from the opposing waveguide walls of the step down sections.

17. An antenna feed of claim 16, wherein the transition sections further comprise:

a step up section between the step down sections and the signal combining transition section, wherein the first and second waveguides are provided laterally spaced from opposing waveguide walls of the step up section for carrying vertical polarization signals of the second band of signals, and wherein the step up section terminates into an opening in the signal combining transition section between the openings for the first and second waveguides.

18. The antenna feed of claim 17, further comprising a dielectric insert, the dielectric insert comprising:

a rectangular body portion having peripheral dimensions substantially matching dimensions of the signal combining transition section, the rectangular body portion being provided in the signal combining transition section;

a tapered conical section extending from a first end of the rectangular body portion;

waveguide inserts extending from a second end of the rectangular body portion into the first and second waveguides, the waveguide inserts having peripheral dimensions substantially matching dimensions of the first and second waveguides, the waveguide inserts extending ¼ wavelength of the first and second waveguides from the rectangular body portion, wherein the rectangular body portion includes a notch provided between the waveguide inserts, wherein the notch extends ¼ wavelength of the signal combining transition section into the rectangular body portion.

* * * * *